US008576077B2

(12) United States Patent
Pitchers

(10) Patent No.: US 8,576,077 B2
(45) Date of Patent: Nov. 5, 2013

(54) SYSTEM AS WELL AS METHOD FOR PROTECTING AN ITEM TO BE SECURED

(75) Inventor: Steve Pitchers, Cambridge (GB)

(73) Assignee: Koninklijke Philips N.V., Eindhoven (NL)

( * ) Notice: Subject to any disclaimer, the term of this patent is extended or adjusted under 35 U.S.C. 154(b) by 943 days.

(21) Appl. No.: 12/063,041

(22) PCT Filed: Jul. 31, 2006

(86) PCT No.: PCT/IB2006/052609

§ 371 (c)(1),
(2), (4) Date: Jun. 8, 2010

(87) PCT Pub. No.: WO2007/017788

PCT Pub. Date: Feb. 15, 2007

(65) Prior Publication Data

US 2010/0253522 A1 Oct. 7, 2010

(30) Foreign Application Priority Data

Aug. 9, 2005 (EP) ..... 05107301

(51) Int. Cl.
*G08B 13/14* (2006.01)
*G06F 19/00* (2011.01)

(52) U.S. Cl.
USPC ..... 340/572.4; 340/572.1; 340/571; 340/539.1; 340/10.1; 235/385

(58) Field of Classification Search
USPC ..... 340/572.1–572.9, 10.1, 10.3, 10.4, 340/10.42, 10.6, 539.1, 568.1, 571, 691.5, 340/693.5; 235/375, 380, 384, 385; 705/22, 705/28
See application file for complete search history.

(56) References Cited

U.S. PATENT DOCUMENTS 5,402,104 A 3/1995 LaRosa
6,297,737 B1 * 10/2001 Irvin ..... 340/571

(Continued)

FOREIGN PATENT DOCUMENTS

CA 2377643 A1 9/2003
GB 2375424 A 11/2002
GB 2400711 A 10/2004

*Primary Examiner* — Anh V La

(57) ABSTRACT

In order to further develop a system (100) as well as a method for protecting at least one item to be secured, for example at least one piece of luggage, the system comprising at least one transponder device (50), in particular at least one electronic tag, being assigned to the item, and at least one monitor device (10, 20), in particular being based on short range radio frequency communication, with at least one transmitting unit (18, 28) for transmitting and/or for broadcasting and/or for multicasting, in particular periodically, at least one request (40, 42) to the transponder device (50), in such way that the monitor device (10, 20) can be carried with him by at least one user and that at the same time it can be discovered whether the item remains nearby the respective monitor device (10, 20), it is proposed that the transponder device (50) comprises at least one processing unit (52) for determining the number (N) of monitor devices (10, 20) being arranged within the range, in particular within the receiving and/or transmitting range, of the transponder device (50), and~having transmitted and/or having broadcasted and/or having multicasted its respective request (40, 42) to the transponder device (50), within a certain time interval, and that the transponder device (50) is designed for transmitting and/or for broadcasting and/or for multicasting at least one response (60, 62) comprising the determined number (N) of monitor devices (10, 20) to the respective monitor device (10, 20) having transmitted and/or having broadcasted and/or having multicasted its respective request (40, 42) to the transponder device (50).

10 Claims, 4 Drawing Sheets

(56) References Cited

U.S. PATENT DOCUMENTS

Figure 2:
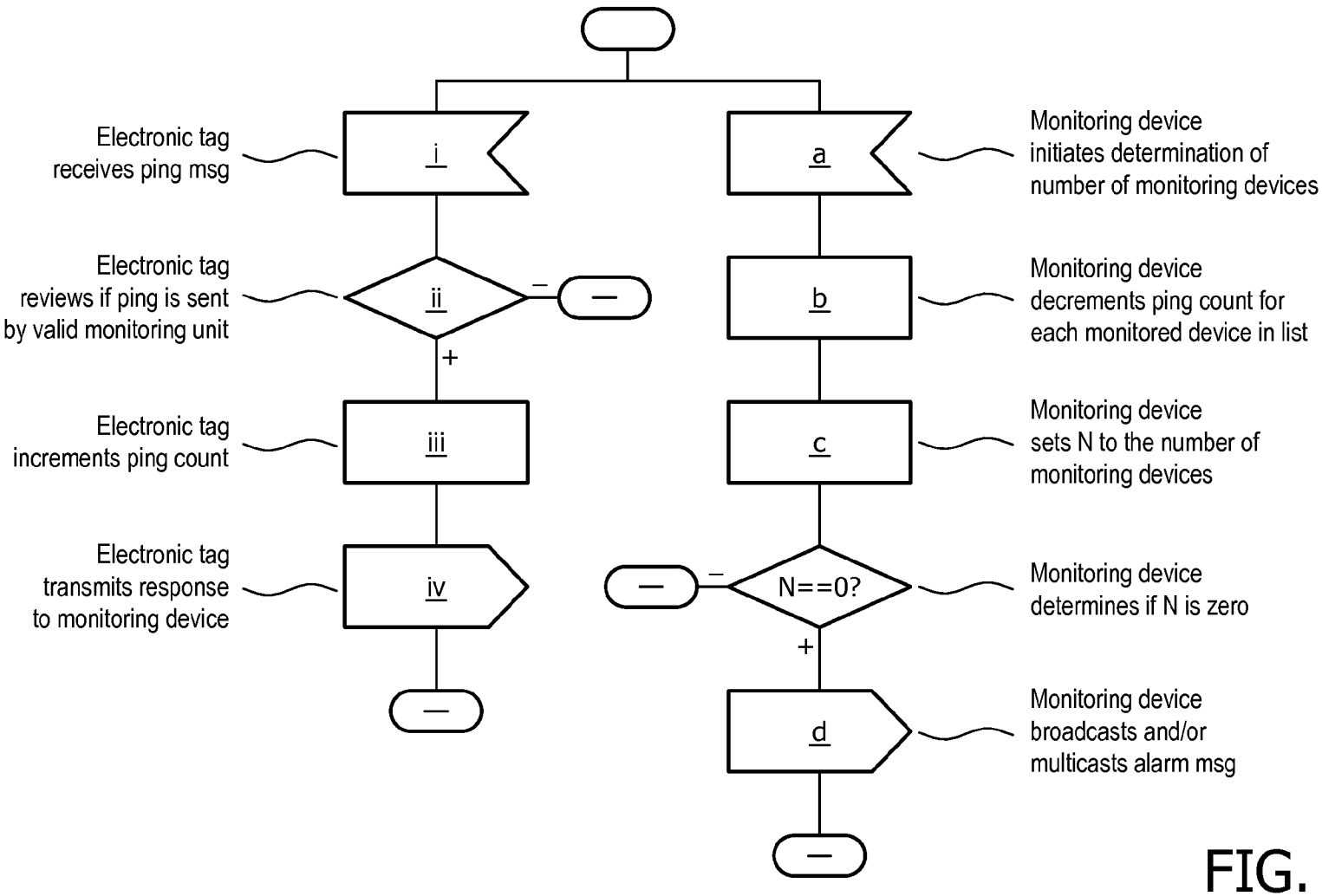

| | | | | |
|---|---|---|---|---|
| 6,331,817 | B1 | 12/2001 | Goldberg | |
| 6,522,253 | B1 * | 2/2003 | Saltus | 340/571 |
| 6,750,757 | B1 * | 6/2004 | Gabig et al. | 340/10.1 |
| 6,900,731 | B2 * | 5/2005 | Kreiner et al. | 340/572.1 |
| 7,274,292 | B2 * | 9/2007 | Velhal et al. | 340/539.32 |
| 2002/0109597 | A1 | 8/2002 | Nelson et al. | |
| 2004/0041707 | A1 | 3/2004 | Hull et al. | |
| 2005/0134459 | A1 | 6/2005 | Glick et al. | |

* cited by examiner

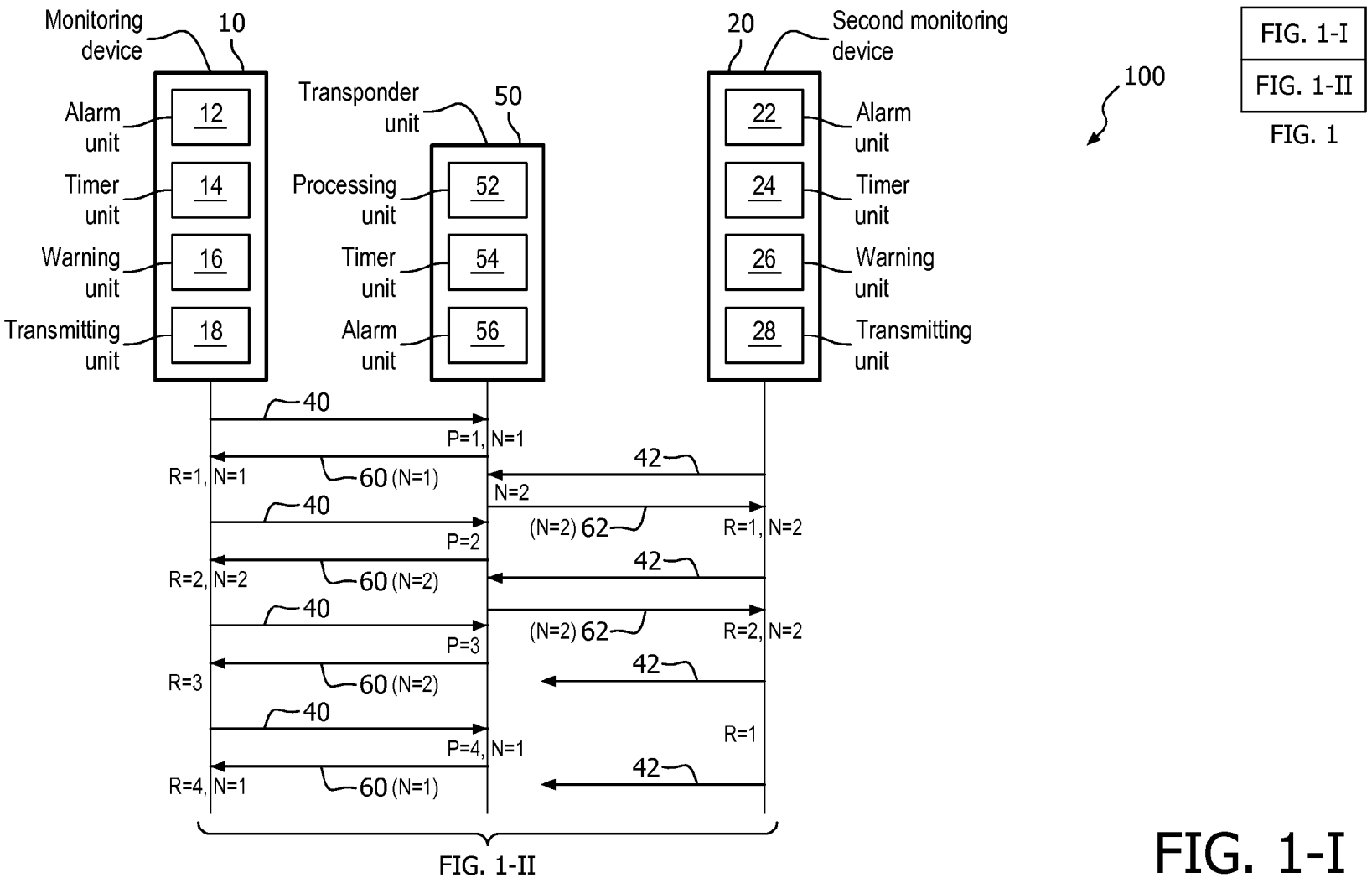
FIG. 1-I

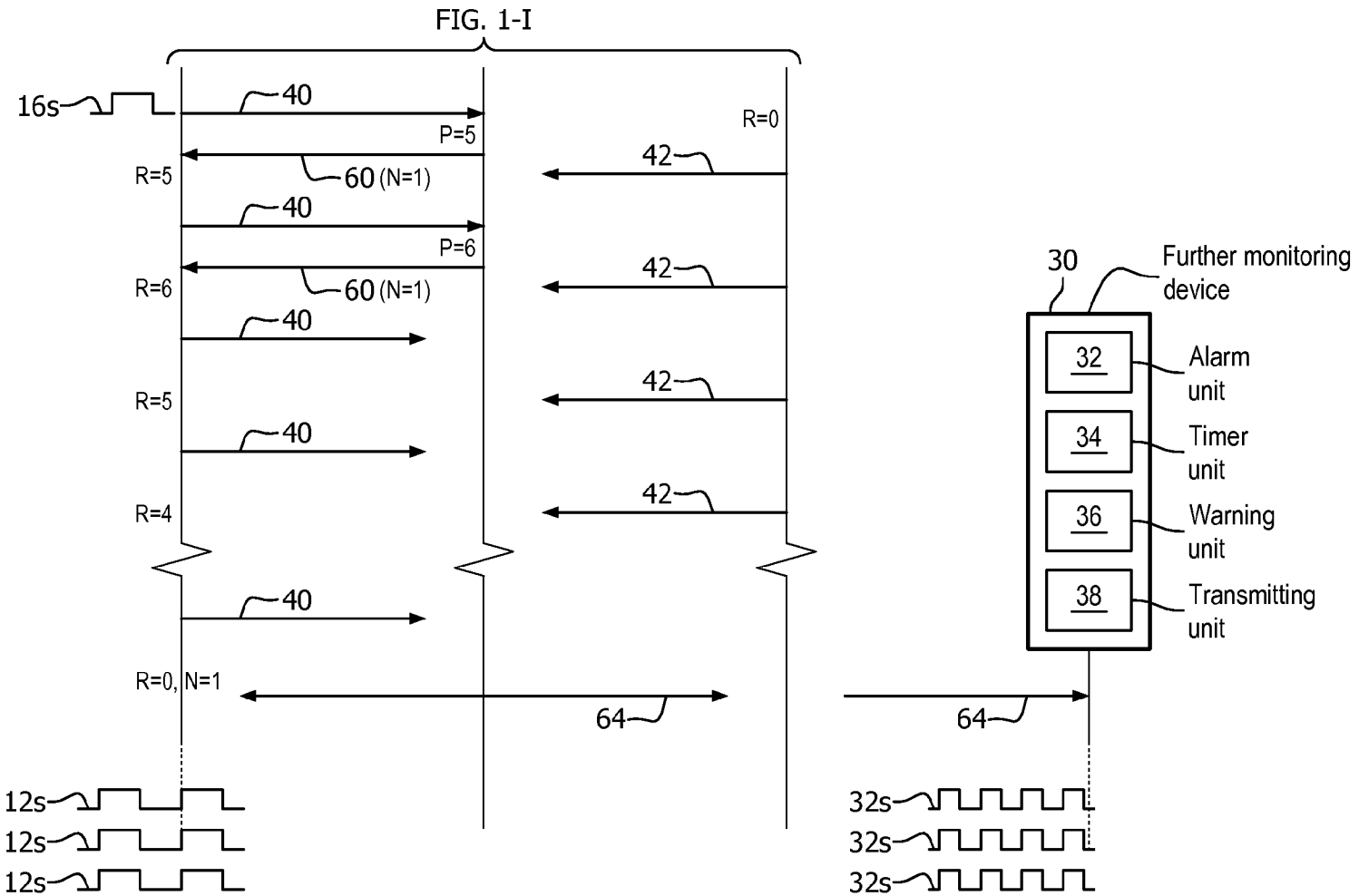
FIG. 1-II

SYSTEM AS WELL AS METHOD FOR PROTECTING AN ITEM TO BE SECURED

The present invention relates to a system for protecting at least one item to be secured, for example at least one piece of luggage, the system comprising at least one transponder device, in particular at least one electronic tag, being assigned to the item, and at least one monitor device, in particular being based on short range radio frequency communication, with at least one transmitting unit for transmitting and/or for broadcasting and/or for multicasting, in particular periodically, at least one request to the transponder device.

The present invention further relates to a method as described in the preamble of claim 6.

Ensuring security of belongings can be a chore for travelers, who need to be constantly observant that they have not left any luggage behind or have suffered a theft. Bags may be left in a luggage area on a bus or on a train, such that they are close by but nevertheless out of sight and may slip the mind.

Conventional luggage labels are adequate for the limited purpose of identifying to whom a piece of luggage belongs. However, conventional luggage labels do nothing to prevent loss, either through forgetfulness or through theft. For this reason, a solution for keeping track of belongings is required.

An additional problem is that often there is more than one carrier or luggage owner traveling together. It is often difficult to know who is currently responsible for keeping track of a particular item of luggage as it is not always clear whether one of the other members of the group are looking after the particular item(s) of luggage.

Moreover, the age profile of the western population is moving upwards, due to increasing life expectancy, and there is currently a trend for early retirement. Older people can therefore look forward to a long retirement. Unfortunately, many elderly people are prone to conditions such as dementia, which often affects the memory. Loss of personal items is a perennial problem for the affected individuals.

At the other end of the age scale, young children are thought to be ever more vulnerable to abduction and the risks of wandering unsupervised near busy roads. In this situation, a solution for monitoring children to ensure that they do not wander too far from their carriers is required.

It has been suggested that children can have a G[lobal]P[ositioning]S[ystem] device attached to their person as an aid to locating them, should they disappear. However, it would be much better to ensure that they do not go missing in the first place. Moreover, GPS devices as mentioned above are very expensive. GPS devices are also very power hungry and require frequent charging.

In prior art document U.S. Pat. No. 5,402,104 a protection transponder for monitoring tags periodically, to see when they disappear is disclosed. However, this protection transponder lacks of working out, when the carriers or supervisors, in particular all of several monitor devices, are out of range.

Moreover, exemplary systems matching the above description are disclosed in prior art document CA 2 377 643 A1, and in prior art document GB 2 375 424 A;

however, these prior art documents do not cater for more than one reader with joint responsibility for the valuable items.

Finally, exemplary systems matching the above description are disclosed in prior art document US 2002/0109597 A1, wherein this prior art document is related to location tracking of objects rather than continually monitoring relative distance from a mobile reader; and in prior art document US 2004/0041707 A1, wherein this prior art document applies only to documents on a single surface.

Starting from the disadvantages and shortcomings as described above and taking the prior art as discussed into account, an object of the present invention is to further develop a system of the kind as described in the technical field and a method of the kind as described in the technical field in such way that the monitor device can be carried with him by at least one user and that at the same time it can be discovered whether the item remains nearby the respective monitor device.

The object of the present invention is achieved by a system comprising the features of claim 1 as well as by a method comprising the features of claim 6. Advantageous embodiments and expedient improvements of the present invention are disclosed in the respective dependent claims.

The present invention is based on the principle to assign, in particular to place, at least one transponder device, in particular at least one electronic tag, to, in particular on, at least one, in particular valuable, item and advantageously to assess the proximity of the item to at least one monitor device, in particular to at least one reader, for protecting the item.

The transponder device can be applied to luggage, jewelry, etc., and can be a good way to ensure that a child does not wander off.

According to a preferred embodiment of the present invention, the transponder device is attached to each item, in particular to each document, person, piece of luggage, etc., within a group of items to be supervised.

Moreover, according to a preferred embodiment each supervisor uses the monitor device, in particular a short range R[adio]F[requency] monitor device, which, in particular periodically, contacts each transponder device to discover whether the item remains nearby. Each item is advantageously deemed to be safe provided that it is close by for example at least one of the supervisors in the group.

According to a particularly advantageous embodiment of the present invention the transponder device keeps track of the number of monitoring devices which have contacted the transponder device recently and transmits this number in at least one response, in particular in at least one reply.

For reducing transmission intensity, advantageously the transponder device is designed to transmit the response only to monitor devices being assigned to the respective transponder device. The transmitted response allows the monitoring device to tell how many other monitor devices are currently within adequate range to supervise the item assigned to the transponder device. Thus, favorably the monitor device knows how many other monitor devices are also supervising the, in particular tagged, item.

Moreover, according to a preferred embodiment of the present invention, each monitor device comprises at least one feedback device or feedback means for giving at least one, in particular visual and/or acoustical and/or haptic and/or tactile, feedback, such feedback device or feedback means being exemplarily implemented by at least one alarm unit for triggering at least one, in particular visual and/or acoustical and/or haptic and/or tactile, alarm signal in case the determined number of monitor devices falls below a predetermined threshold, in particular falls to one, and/or in case the monitor devices, in particular the sole monitor device, being arranged within the range, in particular within the receiving and/or transmitting range, of the transponder device, and having transmitted its respective request to the transponder device, do(es) not receive any response from the transponder device within a certain time interval.

When a supervisor moves out of the range, the transponder device will receive no further signals from that monitor device, and a lower number of monitors will be reported.

If the number of determined nearby monitor devices falls below the predetermined threshold according to a preferred embodiment the transponder device knows that there is now for example only one supervisor in the area, and the response, in particular the return message, also indicates this fact to the remaining monitor device. If the sole monitor device then stops receiving return signals, this monitor device advantageously sounds at least one alarm.

Thus, the present invention for example provides a means to sound an alarm as soon as the item, in particular a child, leaves a protected area. Therewith the present invention offers a practical solution for monitoring for example children to ensure that they do not wander too far from their carriers.

Moreover, the present invention addresses the issue of having more than one monitoring device jointly responsible for the items being monitored. In this context, an advantageous embodiment of the present invention works out when all of several monitor devices are out of range. In contrast thereto, conventional systems cover only monitoring by one monitor device at a time or only each specific location.

By determining the number of monitor devices being arranged within the range, in particular within the receiving and/or transmitting range, of the transponder device, and having transmitted its respective request to the transponder device within a certain time interval, the present invention provides a solution for monitoring the locations of a number of items, in particular persons or things, by another number of carriers, for example to solve the quandary where several travelers are jointly responsible for supervising their collection of luggage or several carriers are jointly responsible for supervising a number of children.

According to a favorable embodiment the transponder device comprises at least one processing unit, which takes for determining the number of monitor devices only the number of monitor devices being assigned to the respective transponder device into account, and/or is designed for counting the number of requests of the respective monitor device, in particular up to a predetermined maximum value.

Moreover according to an advantageous embodiment the transponder device comprises at least one timer unit for decrementing the counted number of requests for the respective monitor device in case a certain time interval expires.

Optionally the transponder device is designed for determining the recent number of monitor devices by summing up all monitor devices for which the counted number of requests is at least one.

Alternatively thereto, the transponder device can be designed for determining the recent number of monitor devices by summing up all monitor devices for which the counted number of requests is at least equal to at least one predetermined threshold.

The transponder device may comprises at least one alarm unit for triggering at least one, in particular visual and/or acoustical and/or haptic and/or tactile, alarm signal in case the transponder device does not receive any request from the monitor device within a certain time interval.

In combination thereto or independently thereof the transponder device can be designed for broadcasting and/or for multicasting at least one alarm message to at least one of the monitor devices and/or to at least one further monitor device being not assigned to the transponder device.

In this context said monitor device is arranged within the range, in particular within the receiving and/or transmitting range, of the transponder device and said alarm message is designed for indicating the monitor device to trigger at least one, in particular visual and/or acoustical and/or haptic and/or tactile, warning signal.

The term "multicast(ing)" (used as an addition or as an alternative to the term "broadcast(ing)") carries the sense of transmitting to a specific group of receivers, in particular of named receivers. In practice, the choice of transmission mode employed can depend on the capabilities of the underlying technology, which might govern the use of broadcast, of multicast or of a series of individual unicasts. Consequently, within the teaching of the present invention, the term "serial (ly) unicast(ing)" and/or "individual(ly) unicast(ing)" may also be used as an addition or as an alternative to the term "broadcast(ing)" and/or to the term "multicast(ing)".

As described above, this invention uses the transponder device for the purpose of keeping track of the item, in particular of belongings. According to a preferred embodiment of the present invention, the transponder device is self adhesive, cheap and disposable.

Moreover, according to a preferred embodiment the transponder device comprises at least one energy source, in particular at least one battery, with the battery life being relatively long; when the battery finally expires, the transponder device may be discarded and substituted by a new one.

Sticky transponder devices can be provided on at least one small reel for individual application to for example plastic shopping bags as items are purchased in shops.

The monitor device will advantageously be larger than the transponder device attached to the valuable item, but will still be small and light enough to be carried easily in a pocket or worn around the wrist.

The present invention leads to the advantage that the system, in particular the transponder device, can be delivered in a small, cheap, disposable package that does not rely on expensive GPS technology.

Moreover, the present invention leads to the advantage, that an activation transponder is not required and that the present invention is not specific to any particular location.

According to an advantageous embodiment, the monitor device monitors the valuable item throughout the whole journey not just at key times.

In general, the present invention can be applied, in any situation where there are valuable items to be monitored, especially where responsibility for looking after the item is shared by more than one person or other entity. It might be used by travellers or by families with young children, as described above.

The present invention might also be used by craftsmen, such as plumbers, who need to be sure that all their tools are accounted for, either by their own efforts or their plumber's mate. There may be interesting industrial applications of this invention.

Moreover, the present invention might be used by older people to prevent them from losing personal items.

Figure 3:
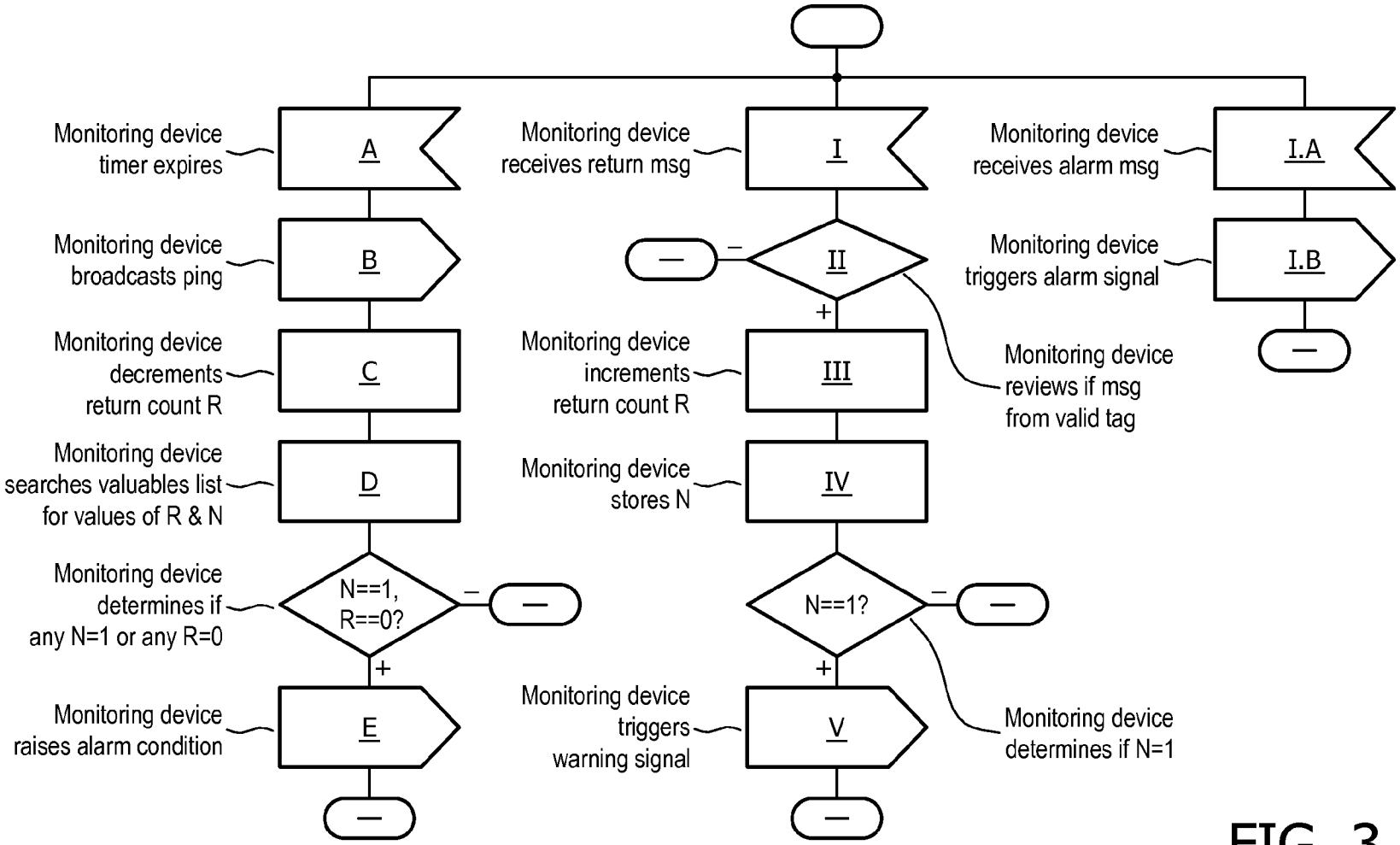

As already discussed above, there are several options to embody as well as to improve the teaching of the present invention in an advantageous manner. To this aim, reference is made to the claims respectively dependent on claim 1 and on claim 6; further improvements, features and advantages of the present invention are explained below in more detail with reference to two preferred embodiments by way of example and to the accompanying drawings where FIG. 1 schematically shows an embodiment of the system according to the present invention working according to the method of the present invention;

FIG. 2 schematically shows a flow chart of the method of the present invention by which method the transponder device of FIG. 1 is operated; and FIG. 3 schematically shows a flow chart of the method of the present invention by which method the monitor device of FIG. 1 is operated.

The same reference numerals are used for corresponding parts in FIG. 1 to FIG. 3.

The system 100 depicted in FIG. 1 comprises a transponder device 50, namely an electronic tag being assigned to a valuable item and two monitor devices 10, 12 being assigned to the electronic tag 50.

Each monitor devices 10, 20 is based on short range radio frequency communication and comprises a transmitting unit 18, 28 for transmitting periodically, at least one request 40, 42, namely a ping message, to the electronic tag 50.

The tag in turn is designed for transmitting at least one response 60, 62, namely a return message, to the monitor devices 10, 20 having pinged 40, 42 the electronic tag 50.

As an example embodiment, FIG. 1 shows a sequence of messages 40, 60 and 42, 62 between the tags belonging to the two joint supervisors of a valuable item. Each supervisor has one of the monitor devices 10, 20 that periodically sends the "ping" message 40, 42 to the tag 50 attached to the valuable item, once every ten seconds.

This tag 50 responds with the "return" message 60, 62, which carries a parameter, N, representing the number of monitors it has recently been in contact with. The parameter N is determined by a processing unit 52 of the tag 50.

For determining if the respective monitor device 10, 20 receives the return message 60, 62 from the electronic tag 50 within a certain time interval each monitor device 10, 20 comprises a timer unit 14, 24 being designed for counting the number R of return messages 60, 62 of the respective electronic tag 50 and for decrementing the counted number R of return messages 60, 62 for the respective electronic tag 50 in case a certain time interval expires.

Moreover, the timer unit is designed for triggering the transmission of the request 40, 42 once every ten seconds.

For triggering at least one, in particular visual and/or acoustical and/or haptic and/or tactile, warning signal 16*s* in case the determined number N of monitor devices 10, 20 falls below a predetermined threshold, in particular falls to one, each monitor device 10, 20 comprises at least one feedback device or feedback means, in particular at least one warning unit 16, 26.

FIG. 1 initially shows two monitor devices 10, 20 within range of the electronic tag 50 being attached to the item, so N becomes two. When the second monitor device 20 moves out of range, N becomes one, but the second monitor device 20 knows that there is another monitor device, namely the first monitor device 10, within range so this is no cause for concern.

However, the remaining monitor device 10 is now the only one within range, so it bleeps 16*s* to indicate that its owner is now solely responsible for looking after the item.

Later, this monitor device 10 also goes out of range. When no return messages 60 have been received for a period of time, the monitor realizes that the item is missing. The monitor device 10 already knows that no other monitor devices are within range, so it sounds a siren 12*s* to raise the alarm. For triggering the visual and/or acoustical and/or haptic and/or tactile alarm signal 12*s* the monitor device 10 comprises an alarm unit 12.

At the same time, the tag 50 on the missing item knows that it is no longer receiving pings 40, 42 from any of its designated monitor devices 10, 20, optionally it too can raise the alarm 16*s*. However, this need not require a alarm unit 56 on the tag 50 itself. Instead, it broadcasts or multicasts an "alarm" message 64 to any monitor devices 10, 20, 30 within range, whether they are normally responsible for this item or not.

There may well be others in the area for example a further monitor device 30 being not assigned to the tag 50 that can assist in returning the missing item to its owner. In this example, after having received the broadcasted or multicasted alarm message 64 the further monitor device 30 transmits an alarm signal 32*s*.

The electronic tag 50 on the valuable item contains a list of the valid monitor devices 10, 20 to which it is programmed to respond (reference numerals 60, 62), and it will ignore any pings from unknown monitor devices such as monitor device 30.

The electronic tag 50 also keeps track of which monitor devices have been heard from recently using the algorithm illustrated in FIG. 2. A ping count, P, associated with each listed monitor device is incremented whenever a ping message 40, 42 is received, up to some maximum value, say seven.

A timer unit 54 periodically reviews the list of ping counts P and assesses the number of monitor devices currently within range. Each ping count P is decremented by one, which will have the effect of gradually reducing the ping count for monitor devices that have not been heard from recently.

By counting the number of monitor devices in the list that have a ping count (value) greater than a threshold, say three, it is possible to derive a reliable indication of the number of supervisors within range. This value, i.e. the number of supervisors is returned as the N parameter in the message 60, 62 sent in response to each ping 40, 42.

If the number of active monitors 10, 20 falls to zero, an alarm 12 *s*, 32*s* is raised by broadcasting and/or by multicasting the special alarm message 64 to any monitor devices 10, 20, 30 within range.

The procedure for the electronic tag 50 attached to a valuable item as depicted in FIG. 2 is started, when the electronic tag 50 receives (reference numeral i in FIG. 2) a ping message from one of the monitor devices 10, 20 30.

Thereupon, the electronic tag 50 reviews (reference numeral ii in FIG. 2) if the received ping message is transmitted by a valid monitor device, in particular by a monitor device being comprised in the list of monitor devices.

In case the ping message was transmitted by a non-valid monitor device, for example by the further monitor device 30, the procedure stops, pending receipt of the next message or timer event.

Otherwise, i.e. if the ping message was transmitted by a valid monitor device, for example by the monitor device 10, the electronic tag 50 increments (reference numeral iii in FIG. 2) the ping count P for this monitor device 10.

Thereupon, the electronic tag 50 transmits (reference numeral iv in FIG. 2) a response 60 to the monitor device 10, this response 60 comprising the number N of monitor devices recently monitoring the electronic tag 50.

The electronic tag 50 initiates the determination of the number N of monitor devices recently monitoring the electronic tag 50 every time, a certain time interval expired (step timer expiry with reference numeral a in FIG. 2).

First, the ping count P is decremented for each monitor device comprised in the list (reference numeral b in FIG. 2).

Thereupon the number N is set (reference numeral c in FIG. 2) to the number of monitor devices with ping count P above or at least equal to a predetermined threshold, in particular by summing up all monitor devices 10, 20 for which the counted number P of requests 40, 42 is above three.

In case the determined number N of monitor devices recently monitoring the electronic tag 50 is zero, the electronic tag 50 broadcasts and/or multicasts the alarm message 64 (reference number d in FIG. 2).

Otherwise, i.e. in case the determined number N of monitor devices recently monitoring the electronic tag 50 is not zero, the procedure is stopped.

Optionally, to prevent false alarms, a different criterion can be used to trigger the alarm 12*s*, 32*s*; rather than using the threshold mentioned above, the alarm 12*s*, 32*s* needs not be sounded until the ping count P for each monitor 10, 20 has reached zero.

FIG. 3 shows an example algorithm for the monitor device 10, 20 worn by each supervisor. The monitor device 10, 20 sends out regular "ping" messages 40, 42 to each of the tagged items 50 within its care, driven by the action of the timer unit 14, 24. Any valuable items associated with this monitor device 10, 20 will respond with the "return" message 60, 62.

The monitor device 10, 20 keeps track of the length of time since each responding tagged item was last heard from, using a similar algorithm to that described above. Upon reception (reference numeral I in FIG. 3) of a return message 60, 62 comprising the determined number N of monitor devices recently monitoring the respective electronic tag 50, the monitor device 10, 20 reviews (reference numeral II in FIG. 3) if the received return message 60, 62 is transmitted by a valid electronic tag 50.

In case the return message 60, 62 was transmitted by a non-valid electronic tag the procedure stops, in particular pending receipt of the next message or timer event.

Otherwise, i.e. in case the response 60, 62 is valuable, the monitor device 10, 20 increments (reference numeral III in FIG. 3) the return count R for this electronic tag 50. Thus, the return count R is incremented for each valuable electronic tag 50 responding.

Moreover, the monitor device 10, 20 stores (reference numeral W in FIG. 3) the number N of reported monitor devices of this valuable electronic tag 50.

The monitor also examines the parameter contained within the return message 60, 62 to see how many other monitor devices are also looking after that tagged item. The reported number of monitors, N, is also recorded for the particular valuable within the list of items.

If the number of monitors for a particular item falls to one, the monitor device, for example the monitor device 10, knows that it now has sole responsibility for looking after the tagged item. Optionally, the warning unit 16 of this sole monitor device 10 can trigger (reference numeral V in FIG. 3) a warning signal 16*s*, in particular bleep, to indicate this.

Periodically, when a predetermined time interval expires (step timer expiry, reference numeral A in FIG. 3), the monitor device 10, 20 transmits and/or broadcasts and/or multicasts (step ping broadcast, reference numeral B in FIG. 3) to all of its assigned the electronic tags 50.

Moreover, periodically the monitor device 10, 20 reviews the list of valid electronic tags 50, in particular the list of items. Each value of return count R is decremented (reference numeral C in FIG. 3) such that the reading will eventually reach zero for any tag 50 that has not been heard from recently.

Thereupon the monitor device 10, 20 searches (reference numeral D in FIG. 3) valuables list for any number N of recently monitoring monitor devices being one and return count R being zero.

If there are any items having a return count R value or zero and which are marked as being the sole responsibility of the monitor, i.e. N is one, an alarm condition is raised (step siren to audio, reference numeral E in FIG. 3). This might take the form of an audible siren that draws the attention of the supervisor to the developing situation.

As an additional option, the tag 50 of the item for example of a child can also be set to raise an alarm (reference numeral E in FIG. 3) when the number of supervisors falls to zero.

Inclusion of an audible or visual or haptic or tactile alarm within the item's own tag 50 might make the tag 50 too expensive to be truly disposable, but there is a better solution. To raise the alarm 12*s*, 32*s*, the tag broadcasts and/or multicasts a special "alarm" message 64 to all monitor devices 10, 20, 30 within the area.

This alarm message 64 would not only be sent to the listed supervisors but to any monitor device for example to the monitor device 30 within range. Nearby adults would thus be alerted to the plight of the lost child. It is suggested that the monitor device 30 sounds in a fashion that can be easily distinguished from the alarm signal 16*s*, in particular siren, described above.

Thus, if the monitor device 10, 20, 30 receives the alarm message 64 transmitted by the tag 10 (step alarm from valuable, reference numeral I.A in FIG. 3), than this monitor device 10, 20 triggers the alarm signal 12*s*, 32*s* (step ring to audio, reference numeral I.B in FIG. 3).

As a practical consideration, the unique identifier within each electronic tag 50 may be synonymous with the "address" concept used by many communication schemes. When a message arrives from a particular unit, the source address within the message header denotes the unique identifier of the sender, in addition to its role as the return address for a response.

This source address can be also be used as the identity code for the purposes of this invention. Thus, the messages 40, 60 and 42, 62 can be identified by this way.

LIST OF REFERENCE NUMERALS

100 system
10 monitor device, in particular first monitor device, being assigned to transponder device 50
12 alarm unit of monitor device 10
12*s* alarm signal being triggered by alarm unit 12 of monitor device 10
14 timer unit of monitor device 10
16 warning unit of monitor device 10
16*s* warning signal being triggered by warning unit 16 of monitor device 10
18 transmitting unit of monitor device 10
20 second monitor device being assigned to transponder device 50
22 alarm unit of second monitor device 20
24 timer unit of second monitor device 20
26 warning unit of second monitor device 20
28 transmitting unit of second monitor device 20

30 further monitor device being not assigned to transponder device 50
32 alarm unit of further monitor device 30
32*s* alarm signal being triggered by alarm unit 32 of further monitor device 30
34 timer unit of further monitor device 30
36 warning unit of further monitor device 30
38 transmitting unit of further monitor device 30
40 request, in particular ping message, being transmitted from monitor device 10 to transponder device 50
42 request, in particular ping message, being transmitted from second monitor device 20 to transponder device 50
50 transponder device, in particular electronic tag
52 processing unit of transponder device 50
54 timer unit of transponder device 50
56 alarm unit of transponder device 50
60 response being transmitted from transponder device 50 to monitor device 10
62 response being transmitted from transponder device 50 to second monitor device 20
64 alarm message being broadcasted and/or being multicasted from transponder device 50 to monitor device 10, to second monitor device 20 and to further monitor device 30
N determined number of monitor devices 10, 20
P number of requests 40, 42 having been received by transponder device 50
R number of responses 60, 62 of transponder device 50

The invention claimed is:

1. A system for protecting at least one item to be secured, the system comprising:
at least one transponder device including at least one electronic tag, being assigned to the item, and
at least one monitoring device being based on short range radio frequency communication, with at least one transmitting unit for transmitting and/or for broadcasting and/or for multicasting at least one request to the transponder device,
wherein the transponder device comprises at least one processing unit for determining the number of monitoring devices and:
being arranged within the receiving and/or transmitting range of the transponder device, and
having transmitted and/or having broadcasted and/or having multicasted its respective request to the transponder device, within a certain time interval, and
wherein the transponder device is configured for transmitting and/or for broadcasting and/or for multicasting at least one response comprising the determined number of monitoring devices to the respective monitoring device having transmitted and/or having broadcasted and/or having multicasted its respective request to the transponder device.

2. The system of claim 1,
wherein each monitoring device comprises at least one alarm unit for triggering at least one of: a visual and/or acoustical and/or haptic and/or tactile alarm signal:
in case the determined number of monitoring devices falls below a predetermined threshold, and/or
in case the monitoring devices and,
being arranged within the receiving and/or transmitting range, of the transponder device, and
having transmitted and/or having broadcasted and/or having multicasted its respective request to the transponder device, do(es) not receive any response from the transponder device within the certain time interval.

3. The system of claim 1, wherein each monitoring device comprises:
at least one timer unit for determining if the respective monitoring device receives the response from the transponder device within the certain time interval, the timer unit being configured:
for triggering the transmission and/or the broadcast and/or the multicast of the request, and/or
for counting the number of responses of the respective transponder device, and/or
for decrementing the counted number of responses for the respective transponder device in case the certain time interval expires, and/or
at least one warning unit for triggering at least one of: a visual and/or acoustical and/or haptic and/or tactile warning signal in case the determined number of monitoring devices falls below a predetermined threshold.

4. The system of claim 1, wherein the processing unit:
takes for determining the number of monitoring devices only the number of monitoring devices being assigned to the respective transponder device into account, and/or
is configured for counting the number of requests of the respective monitoring device, up to a predetermined maximum value, and/or
comprises at least one timer unit for decrementing the counted number of requests or the respective monitoring device in case the certain time interval expires, and/or
is configured for determining the recent number of monitoring devices:
by summing up all monitoring devices for which the counted number of requests is at least one or
by summing up all monitoring devices for which the counted number of requests is at least equal to and/or is above at least one predetermined threshold.

5. The system of claim 1, wherein the transponder device:
is configured to transmit and/or to broadcast and/or to multicast the response only to monitoring devices being assigned to the respective transponder device, and/or
comprises at least one alarm unit for triggering at least one of: a visual and/or acoustical and/or haptic and/or tactile, alarm signal in case the transponder device does not receive any request from the monitoring device within the certain time interval, and/or
is configured for broadcasting and/or for multicasting at least one alarm message:
to at least one of the monitoring devices, and/or
to at least one further monitoring device being not assigned to the transponder device,
said monitoring device being arranged within the receiving and/or transmitting range, of the transponder device and said alarm message being configured for indicating the monitoring device to trigger at least one of: a visual and/or acoustical and/or haptic and/or tactile warning signal.

6. Use of at least one system of claim 1:
for monitoring a single item to be secured, selected from one of:
for supervising one valuable item, and/or
for supervising an item where responsibility for looking after the item is shared by more than one person or other entity, and/or
for monitoring a number of items to be secured selected from one or more of:
for preventing loss of personal items of older people, and/or
for supervising the tools of craftsmen, and/or
for supervising at least one group of young children, and/or
for supervising pieces of luggage of travelers.

7. A method for protecting at least one item to be secured, wherein for monitoring the item:

at least one transponder device, is assigned to the item, and at least one monitoring device, transmits and/or broadcasts and/or multicasts, at least one request to the transponder device, wherein the transponder device determines the number of monitoring devices:

being arranged within the receiving and/or transmitting range, of the transponder device, and having transmitted and/or having broadcasted and/or having multicasted its respective request to the transponder device within a certain time interval, and wherein the transponder device transmits and/or broadcasts and/or multicasts at least one response comprising the determined number of monitoring devices to the respective monitoring device having transmitted and/or broadcasted and/or multicasted its respective request to the transponder device.

8. The method of claim 7, wherein at least one of a visual and/or acoustical and/or haptic and/or tactile, alarm signal is triggered:

in case the determined number of monitoring devices falls below a predetermined threshold, and/or in case the monitoring devices, being arranged within the receiving and/or transmitting range of the transponder device, and having transmitted and/or broadcasted and/or multicasted its respective request to the transponder device, do(es) not receive any response from the transponder device within a certain time interval.

9. The method of claim 7, wherein the step of determining if the respective monitoring device receives the response from the transponder device within the certain time interval, comprises:

counting the number of responses of the respective transponder device, and/or decrementing the counted number of responses for the respective transponder device in case the certain time interval expires.

10. The method of claim 7, characterized in that the step of determining the number of monitoring devices being assigned to the respective transponder device, comprises the steps of:

counting the number of requests of the respective monitoring device, and/or decrementing the counted number of requests for the respective monitoring device in case the certain time interval expires, and/or determining the recent number of monitoring devices:

by summing up all monitoring devices for which the counted number of requests is at least one, or by summing up all monitoring devices for which the counted number of requests is at least equal to and/or is above at least one predetermined threshold.

* * * * *